US005832882A

United States Patent [19]

Matsuda

[11] Patent Number: 5,832,882

[45] Date of Patent: Nov. 10, 1998

[54] FUEL PRESSURE CONTROL VALVE FOR ENGINES OF MODELS

[75] Inventor: Norio Matsuda, Mobara, Japan

[73] Assignee: Futaba Denshi Kogyo K.K., Mobara, Japan

[21] Appl. No.: 917,884

[22] Filed: Aug. 27, 1997

[30] Foreign Application Priority Data

Aug. 29, 1996 [JP] Japan ..... 8-228770

[51] Int. Cl.[6] ..... F02B 33/04

[52] U.S. Cl. ..... 123/73 R; 123/DIG. 3; 123/DIG. 5

[58] Field of Search ..... 123/73 R, 459, 123/DIG. 3, DIG. 5, 531, 533

[56] References Cited

U.S. PATENT DOCUMENTS

| | | | |
|---|---|---|---|
| 2,579,023 | 12/1951 | Thomas | 123/DIG. 5 |
| 2,935,057 | 5/1960 | Perlewitz | 123/DIG. 5 |
| 3,734,072 | 5/1973 | Yamda | 123/DIG. 5 |
| 4,359,975 | 11/1982 | Heidner | 123/73 R |
| 4,471,728 | 9/1984 | Borst et al. | 123/73 R |
| 5,488,933 | 2/1996 | Pham | 123/DIG. 3 |
| 5,700,402 | 12/1997 | Jones et al. | 123/DIG. 5 |

*Primary Examiner*—Thomas N. Moulis

*Attorney, Agent, or Firm*—Oblon, Spivak, McClelland, Maier & Neustadt, P.C.

[57] ABSTRACT

Fuel to which a predetermined pressure is applied is supplied to an electronically controlled fuel injection system of a engine for models in order to improve the rotation stability during low speed operation and the response to rapid acceleration or deceleration.

The pulsatory air pressure is generated in a crank chamber of a engine for models during operation. An air pressure intake guide 51 of a fuel pressure control valve 1 receives air pressure from the crank chamber. The air intake guide is provided with an excessive pressure leak valve the actuation pressure of which is adjustable. The air pressure intake guide communicates with interposition of a check valve 56 to a controlled air pressure supply passage 54 which communicates to a fuel tank. The check valve 56 supplies the positive pressure of the pulsatory air pressure from the controlled air pressure supply passage to the internal of the fuel tank. All the positive air pressure supplied to the air pressure intake guide 51 is supplied to the fuel tank when the pressure in the fuel tank is below a specified pressure. The air pressure supplied to the air pressure intake guide 51 actuates a control ball 60 of the excessive pressure leak valve 57 and is released to the outside. The check valve 56 prevents the air pressure in the fuel tank from flowing inversely.

5 Claims, 4 Drawing Sheets

25
50
51
52
54
56
57
58
59
60
61
62
63
64
65
66
2B

FUEL PRESSURE CONTROL VALVE FOR ENGINES OF MODELS

BACKGROUND OF THE INVENTION

1. Field of the Invention

This invention relates to a fuel pressure control valve provided to an engine of a model having an electronic controlled fuel injection system for pressurizing fuel within a predetermined pressure range using varying air pressure generated in a crank chamber during driving.

2. Description of Related Art

Heretofore, in glow engines of two-cycle or four-cycle which have been known as the engine for models, a carburetor 100 having the structure as shown in FIG. 10 as the means for controlling the feeding rate of fuel to a combustion chamber of an engine has been used.

In the housing 101 of the carburetor 100, a valve body 102 having the shape like a cylinder is provided rotatably around the axis line of the valve body 102 itself. A pipe conduit 101*a* and 101*b* extends vertically through the housing 101, and air is supplied from the upper pipe conduit 101*a*. A passage 102*a* extends through the valve body 102, and the passage is communicated to the pipe conduits 101*a* and 101*b* of the housing 101 with the opening dependent on the rotation angle of the valve body 102. An operating arm 103 is connected to a portion of the valve body 102 which projects beyond the one end of the housing 101. An operating part of a servo mechanism not shown in the drawing is connected to the operation arm 103, and the servo mechanism rotates the valve body 102 in the housing 101. A needle 104 is fixed to the valve body 102 with a screw, and the projection into the valve body 102 is adjustable by turning the needle 104.

A fuel control needle valve 105 is built-in at the other end of the housing 101. The needle valve 105 has a tube 106 and a needle 107 provided in the tube 106. The needle 107 is fixed to the tube 106 with a screw, and the needle 107 is moved inversely in the tube 106 by turning a knob 108 provided at the base of the needle and the tip opening of the tube 106 can be adjusted. The tip of the needle 104 provided to the valve body 102 is facing to the opening of the tip of the tube 106 of the needle valve 105.

Fuel fed to the needle valve 105 is jetted from the clearance between the tip of the tube 106 and the needle 107 to the internal, mixed with air supplied in the valve body 102, and fed to an engine. Because the flow rate of fuel can be adjusted by turning the know of the needle valve 107, the flow rate of fuel (or air-fuel ratio) can be previously set so that the engine rotates at the maximum rotation speed. The servo mechanism rotates the valve body 102 to adjust air flow rate into the valve body 102, and controls the flow rate of fuel fed to the engine.

Methods for supplying fuel to the above-mentioned carburetor 100 such as a method that exhaust pressure of an engine is introduced to a fuel tank to pressurize the fuel surface of the fuel, and a method that fuel is supplied with pressure from a fuel tank to a needle valve 107 using a pump have been known.

The above-mentioned methods for supplying fuel to a carburetor 100 supply fuel to a needle valve 107 not in proportion to the rotation speed, and are lack in accuracy of air-fuel ratio. Therefore, the rotation is not sufficiently stable particularly during low speed operation (idling), and the response to rapid acceleration and deceleration is insufficient. Further, when gravity or centrifugal force is exerted to the fuel during acrobatic flying, the air-fuel ratio can not be maintained due to variation in quantity of the fuel to cause unstable rotation speed, and the engine stalls in the worst case. Such trouble is a problem.

The inventors of the present invention proposed an engine for models provided with an electronic controlled fuel injection system. Fuel pressurized with a constant pressure is injected into a combustion chamber of the engine for models with time controlling. According to the electronic controlled fuel injection system, the engine for models can supply fuel stably with maintaining the air-fuel balance even under severe use condition, and provides quick response. However, such electronic controlled fuel injection system should maintain consistently the fuel pressure within a predetermined pressure range because the fuel injection quantity is controlled depending only on the opening time of the injection orifice.

One of the above-mentioned methods, namely the method that exhaust pressure of an engine is introduced into a fuel tank, provides only low fuel pressure because exhaust pressure is low. This method is suitable for a needle valve but not suitable for an electronic controlled fuel injection system, because the electronic controlled fuel injection system which employs this method supplies fuel insufficiently due to the low fuel pressure. The other one of the above-mentioned methods, namely the method that fuel is supplied with pressure using a pump, is not suitable for an electronic controlled fuel injection system which controls the fuel injection quantity depending on the opening time of the injection orifice because fuel pressure is not controlled within a pressure range but flow rate of fuel is controlled. Conventional methods which supply pressurized fuel are all not suitable for an electronic controlled fuel injection system.

It is the object of the present invention to provide a fuel pressure control valve which is capable of supplying fuel to a needle valve in proportion to rotation speed, capable of stable rotation during low speed operation and quick response to rapid acceleration and deceleration, capable of stable continuous rotation speed operation with maintaining the air-fuel ratio even during acrobatic flying in the case that the fuel pressure control valve is applied to an engine of a model plane, and further capable of using an electronic controlled fuel injection system instead of a needle valve.

SUMMARY OF THE INVENTION

The present invention has been made in view of the foregoing disadvatages of the prior art.

The fuel pressure control valve for engines of models described in claim 1, which is provided to an engine for models for applying a predetermined pressure to fuel using the fluctuating air pressure generated in a crank chamber during operation, is provided with an excessive pressure leak valve which is actuated when the air pressure supplied from the crank chamber exceeds a predetermined value to release partially the air pressure to the outside, and a check valve for preventing the air pressure applied to fuel from flowing inversely to the supply side.

The fuel pressure control valve for engines of models described in claim 2 is a fuel pressure control valve for engines of models, wherein the fuel to which the air pressure is applied is contained in a sealed fuel tank.

The fuel pressure control valve of an engine for models described in claim 3 is a fuel pressure control valve for engines of models, wherein the fuel to which the air pressure is applied is supplied to an electronic controlled fuel injection system.

The fuel pressure control valve of an engine for models described in claim 4 is a fuel pressure control valve for engines of models, wherein the fuel pressure control valve has a pressure sensor for detecting the air pressure supplied from the crank chamber.

The fuel pressure control valve of an engine for models described in claim 5, which is provided to an engine for models for applying a predetermined pressure to fuel using the fluctuating air pressure generated in a crank chamber during operation, is provided with an air pressure intake guide for guiding the air pressure from the crank chamber to the sealed space, an excessive pressure leak valve provided to the air pressure intake guide and for releasing partially the air pressure from the air pressure intake passage to the outside when the air pressure supplied from the crank chamber exceeds a predetermined value, a check valve for preventing the air pressure applied to the sealed space from flowing inversely to the air pressure intake guide, an outside air intake port for communicating from the air pressure intake guide to the outside air, an intake valve for preventing air from releasing from the outside air intake port to the outside when the air pressure generated in the crank chamber becomes positive, and for allowing air to flow from the outside air intake port to the crank chamber when the air pressure generated in the crank chamber becomes negative which intake valve is provided to the outside air intake port.

DETAILED DESCRIPTION OF THE PREFERRED EMBODIMENTS

Figure 1:
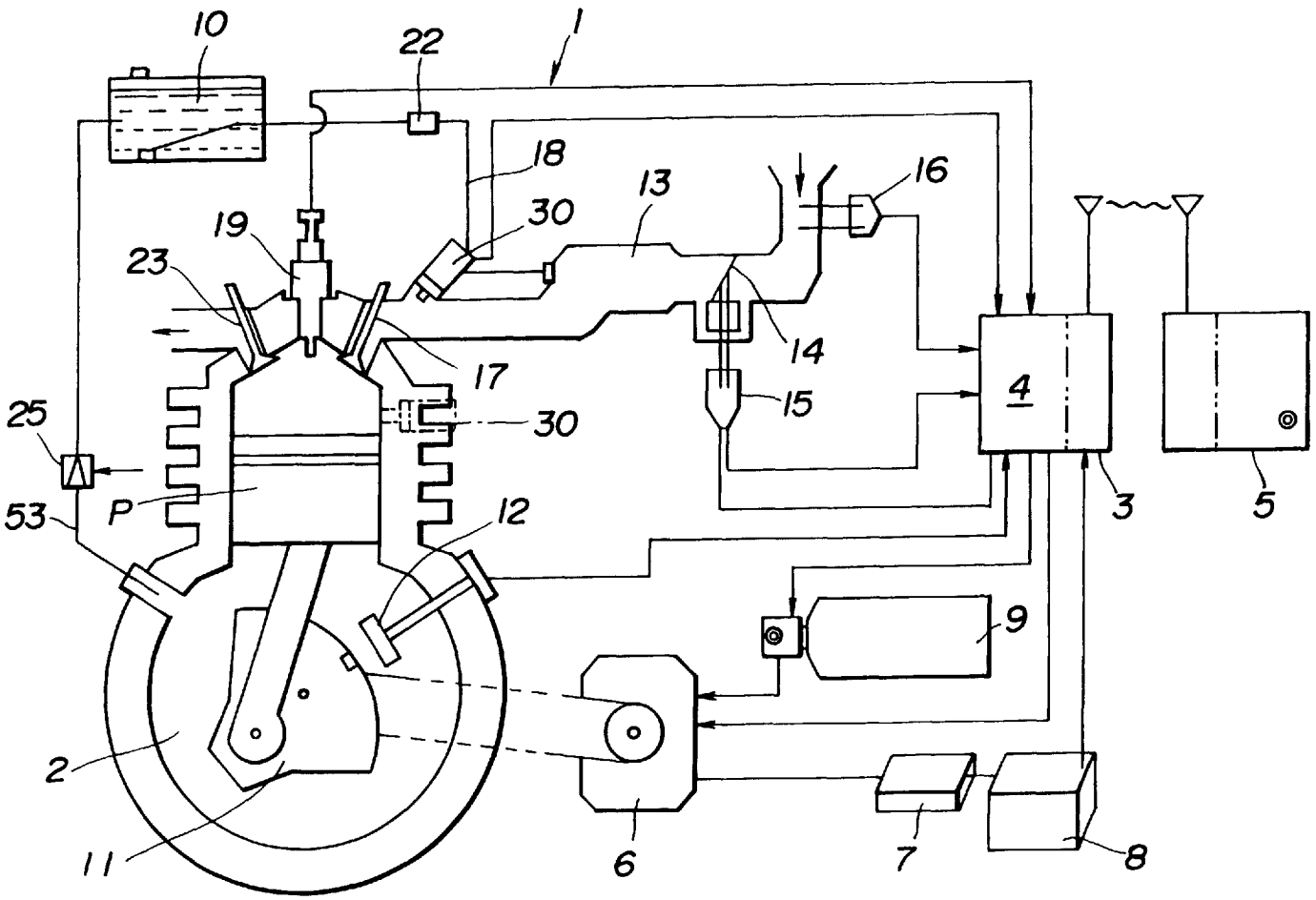
FIG. 1 is a schematic structural diagram of an engine of the first exemplary fuel pressure control valve in accordance with the embodiment of the present invention.

The first example of the embodiment of the present invention is described in detail hereinafter referring to FIG. 1 and FIG. 2. This embodiment involves an engine for models provided with a programmed fuel injector. The engine for models 1 (referred to as engine 1 hereinafter) of this embodiment is an engine to be mounted on a radio control model plane. The engine 1 shown in FIG. 1 is a four-cycle engine which uses methyl alcohol fuel containing lubricating oil and ignition accelerating agent such as nitromethane. The capacity of the combustion chamber is in a range from 1 to 30 cc. The pressure caused in the crank chamber 2 during operation pulses in a range having the maximum positive pressure of 100 Pa and the minimum negative pressure of −100 Pa. The positive pressure and negative pressure are the value based on the reference of the average pressure in the crank chamber. The absolute value of the pressure increases with increasing in rotation speed of the crank.

The engine 1 is controlled by a control means 4 of a receiver 3 mounted on the radio control model plane. When an operator operates the transmitter 5, the receiver 3 receives radio wave from the transmitter 5, and the radio wave controls every parts of the model plane including the engine 1.

The engine 1 shown in FIG. 1 is started up by a starter 6. The starter 6 is driven by power supplied from the battery 8 through a rectifier 7 or pressurized air supplied from an pressurizing means 9.

A rotation detection sensor 12 for detecting the position of the rotating crank 11 as a stroke detection means for detecting the operation cycle of the engine 1 and outputting the stroke signal is provided in the crank chamber 2. The rotation detection sensor 12 detects rotation of the engine 1 for matching the fuel injection timing. The output from the rotation detection sensor 12 is sent to the control means 4 of the radio control receiver 3, and served to control the engine 1.

An intake manifold 13 of the engine 1 is provided with a throttle valve 14 for controlling intake air. A throttle valve driving means 15 controls the opening of the throttle valve. An intake air and temperature sensor 16 is provided at the air intake inlet of the intake manifold 13, the signal generated from the sensor is supplied to the control means 4 of the radio control receiver 3 and used for controlling the engine 1.

The fuel injector 30 is provided near the intake valve 17 of the intake manifold 13. The fuel injector 30 and a fuel tank 10 are connected with interposition of a filter 22. The fuel flows out from the fuel tank 10 and is supplied to the electronic controlled fuel injection system 30 through the filter 22.

The electronic controlled fuel injection system 30 is provided with a solenoid coil in a box. A valve body which is inserted movably into the solenoid coil is forced in the predetermined direction by a forcing means to close the injection orifice. When a current is supplied to the solenoid coil, the valve body is moved in the direction opposite to the above-mentioned forcing direction and the injection orifice is opened. Fuel which is maintained at a predetermined pressure is introduced from the fuel tank 10 into the box. Fuel is injected from the injection orifice to the outside only during a time period while a current is supplied to the solenoid coil to open the injection orifice.

25 is a fuel pressure control valve. The fuel pressure control valve 25 has a function to pressurize fuel to a pressure within a predetermined range using pulsatory air pressure generated in the crank chamber 2 during operation of the engine. As shown in FIGS. 2(*a*) and 2(*b*), an air pressure intake port 51 which is a in-flow passage of air pressure is formed in the body 50. An air pressure intake passage 52 communicates to the air pressure intake port 51. The one end of a connection pipe 53 is connected to the air pressure intake passage 52, and the other end of the connection pipe is connected to the crank chamber 2 as shown in FIG. 1. The pulsatory air pressure generated in the crank chamber 2 during operation of the engine 1 is introduced into the air pressure intake port 51 of the fuel pressure control valve 25.

A control air pressure supply passage 54 is connected to the air pressure intake port 51 of the fuel pressure control valve 25. The control air pressure supply passage 54 is connected to the fuel tank 10 with interposition of a connection pipe 55. The fuel tank 10 has the sealed structure. A check valve 56 is provided for preventing air pressure in the fuel tank 10 from flowing inversely to the air pressure intake port 51. The check valve 56 has a structure as shown in FIG.

2(*c*), that a thin disk consisting of flexible material has a groove to form a monolithic disk-like valve body with a small diameter. Therefore, the air pressure applied to the internal of the fuel tank 10, applied to connection pipe 55 communicated to the fuel tank 10, and applied to control air pressure supply passage 54 does not leak to the air pressure intake port 51 side, and the air pressure in the internal is maintained constant.

An excessive pressure leak valve 57 is provided to the air pressure intake port 51 of the fuel pressure control valve 25. The excessive pressure leak valve 57 is brought into operation when the air pressure supplied from the crank chamber 2 exceeds a predetermined value to release the air pressure to the outside. The excessive pressure leak valve 57 comprises a tapered seat face 59 on which a release hole 58 communicating to the air pressure intake port 51 is formed, a spherical control ball 60 disposed in contact with the seat face 59, a control spring 61 provided as a forcing means to press the control ball onto the seat face 59, and an adjusting screw 62 which is screwed into the body which holds the control spring 61 between the adjusting screw 62 and the control ball 60. A through hole 63 is provided along the center line of the adjusting screw 62, and the through hole 63 is communicated to the release hole 58 through the seat face 59. By adjusting screwed depth of the adjusting screw 62 into the body 50, the force of the control spring 61 for pressing the control ball 60 onto the seat face 59 can be adjusted. In detail, when the air pressure in the air pressure intake port 51 comes to the actuating pressure of the excessive pressure leak valve 57, the air pressure in the air pressure intake port 51 pushes up the control ball 60 to open the release hole 58, and the air pressure in the air pressure intake port 51 is released.

An outside air intake port 64 through which the air pressure intake port 51 communicates to the side air is provided to the air pressure intake port 51 of the fuel pressure control valve 25. An intake valve 65 is provided between the outside air intake port 64 and the air pressure intake port 51. The intake valve 65 has a structure similar to the structure of the check valve 56, which is shown in FIG. 2(*c*). The intake valve 65 is closed to prevent air from releasing from the outside air intake port 64 to the outside when the air pressure generated in the crank chamber is positive. The intake valve 65 is opened to allow air to flow from the outside air intake port 64 into the air pressure intake port 51 and allow air to flow into the crank chamber when the air pressure generated in the crank chamber 2 is negative.

If air is allowed to flow into the crank chamber 2 when the piston goes up and the pressure in the crank chamber 2 becomes negative, the resistance exerted on the piston P due to the negative pressure is reduced, and the piston P can goes up smoothly. However, because the cylinder which accommodates the piston P and the crank chamber 2 are structured air tight not completely and have some air gaps which allow air flow, it is not true that the fuel pressure control valve 25 can not function unless the outside air intake port 64 is not provided. The outside air intake port 64 may not be provided to the fuel pressure control valve 25, and may be provided directly to, for example, the crank chamber 2.

Figures 2A, 2B, 2C:
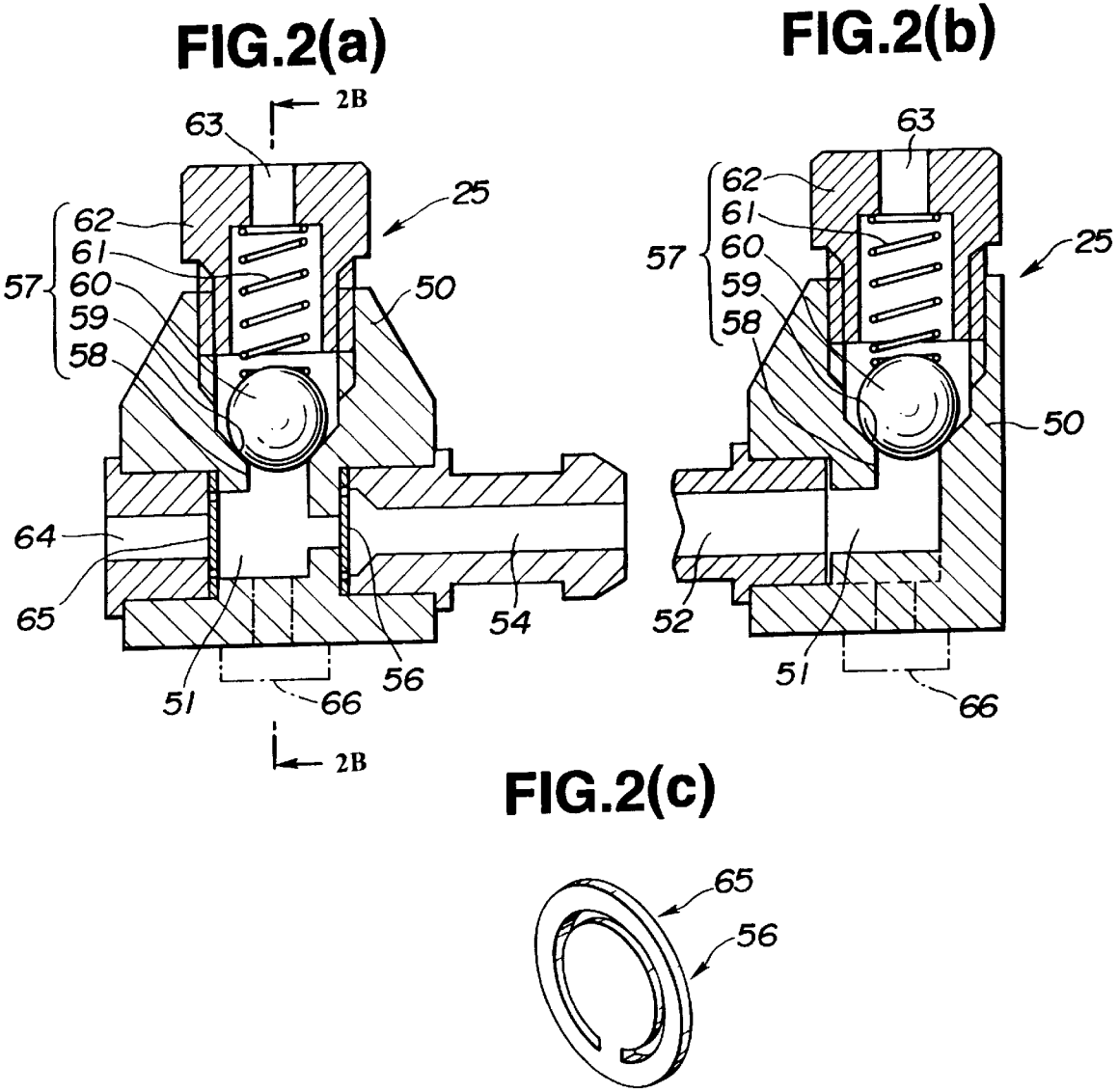
FIG. 2 is a set of diagrams, FIG. 2(*a*) is a cross-sectional view of the first exemplary fuel pressure control valve in accordance with the embodiment of the present invention, FIG. 2(*b*) is a cross-sectional view along the line B—B in FIG. 2(*a*), and FIG. 2(*c*) is a perspective view of a check valve used with the fuel pressure control valve.

As shown in FIGS. 2(*a*) and 2(*b*) with an imaginary line, the fuel pressure control valve may involves a mechanism that a pressure sensor 66 is provided to the air pressure intake port 51 of the fuel pressure control valve 25, the driving cycle of the engine 1 is detected based on the pressure variation in the crank chamber 2, and thereby the fuel injection timing of the electronic controlled fuel injection system 30 is controlled.

Next, the operation of the embodiment is described.

The engine 1 for models of the embodiment is a four-cycle engine, the operation is continued by repeating suction stroke, compression stroke, explosion stroke, and exhaust stroke. The air pressure in the crank chamber 2 fluctuates due to reciprocating motion of the piston P during operation. The pressure in the crank chamber 2 is reduced when the piston P goes up during an exhaust stroke. The pressure in the crank chamber 2 is increased when the piston P goes down during a suction stroke. The pressure in the crank chamber 2 is reduced when the piston P goes up during a compression stroke. The pressure in the crank chamber 2 is increased when the piston P goes down during an explosion stroke. As described herein above, the pulsatory pressure (air pressure) is generated in the crank chamber 2 in response to the motion of the piston P. The pulsatory air pressure pulses in a range having the positive pressure peak value of about 20 kPa to 100 kPa and having the negative pressure peak value of −20 kPa to −100 kPa based on the reference of the average pressure In the crank chamber 2. Because the crank chamber 2 is substantially sealed excepting communication to the fuel pressure control valve 25, the absolute value of the pulsatory air pressure increases with increasing In rotation speed of the crank.

The pulsatory air pressure in the crank chamber 2 is supplied to the air pressure intake port 51 of the fuel pressure control valve 25. Only the positive pressure out of the pulsatory air pressure which pulses between positive pressure and negative pressure is utilized selectively by the check valve 56, and supplied to the internal of the fuel tank which has the sealed structure through the control air pressure supply tube. The pressure which is to be applied to the fuel in the fuel tank 10 can be set to a desired pressure using the adjusting screw 62 of the excessive pressure leak valve 57. When the pressure in the fuel tank 10 is lower than the desired pressure, all the positive pressure supplied to the air pressure intake port 51 is supplied to the internal of the fuel tank 10. When the pressure in the fuel tank 10 satisfies the desired pressure, the air pressure is not supplied to the internal of the fuel tank 10, but pushes up the control ball 60 of the excessive leak valve 57 and is released to the outside of the excessive leak valve 57. After air flows into the fuel tank 10, the check valve does not allow the air pressure to flow inversely from the fuel tank 10 to the outside.

When the piston P goes up and a negative pressure is generated in the crank chamber 2, outside air is sucked into the air pressure intake port 51 through the outside air intake port 64 and intake valve 65, further into the crank chamber 2. After outside air is sucked into the crank chamber 2 where the pressure is negative, the piston P goes down to compress the air in the crank chamber 2, thereby the pressure in the crank chamber 2 rises easily. In other words, because the fuel pressure control valve 25 helps air pressure generation operation in the crank chamber 2, pressurization in the fuel tank 10 is performed efficiently. The intake valve 65 is closed when the pressure in the crank chamber 2 becomes positive, and the air pressure is released from the crank chamber 2 not to the outside instead of the fuel tank 10.

The fuel pressure control valve 25 performs the above-mentioned operations, thus the fuel in the sealed fuel tank 10 is maintained at a certain pressure range. The fuel is supplied to the electronic controlled fuel injection system 30 through the filter 22.

In the electronic controlled fuel injection system 30, when a current is not supplied to the solenoid coil, the valve body closes the injection orifice with aid of the forcing means which exerts a pressing force, and fuel is not injected. When a current is supplied to the solenoid coil, the valve body moves in the direction opposite to the direction of the above-mentioned pressing force, and the injection orifice is opened. Fuel maintained in a certain pressure range has been introduced into the internal of the box of the electronic controlled fuel injection system 30, and then the fuel is injected from the injection orifice to the outside during a time period while a current is supplied to the solenoid coil and the injection orifice is opened.

The electronic controlled fuel injection system 30 operates fuel injection at a predetermined timing synchronously with the stroke of the engine 1. Driving of the electronic controlled fuel injection system is controlled by the controller 4. The fuel injection timing is controlled by the rotational position sensor 12 which detects the position of the crank 11 (alternately, may be controlled by a signal from the pressure sensor 66 provided to the fuel pressure control valve 25 as described hereinbefore). The rotational position sensor 12 detects the position of the crank 11, and when the rotational position sensor 12 detects starting of opening motion of the intake valve 17, upon receiving the starting signal the controller 4 supplies immediately a current to the solenoid coil of the fuel injection system to start fuel injection. Because a four-cycle engine rotates twice for one cycle, the injection timing may be detected using a poppet cam shaft (not shown in the drawing). The quantity of fuel injection is determined suitably dependently on the opening of the throttle valve 14, intake air quantity from the air intake port of the intake manifold 13, and a signal from the temperature sensor 16.

As described herein above, the electronic controlled fuel injection system 30 controls the quantity of fuel injection by way of controlling the time period while a current is supplied to the solenoid coil to open the injection orifice. In the operation of the engine 1, the time required for one cycle becomes shorter as the engine rotates faster. Because the electronic controlled fuel injection system 30 opens the injection orifice for a required time period for every operation cycle of the engine, the control of the injection quantity becomes difficult as the time for one cycle becomes shorter, and it can happen that one injection can not be completed within one cycle.

According to the fuel pressure control valve 25 of the embodiment, fuel in the substantially sealed fuel tank 10 is pressurized at a predetermined pressure or in a predetermined pressure range utilizing the pressure in the crank chamber 2 which varies dependently on the rotation speed of the engine 1. The predetermined pressure is variable and adjustable simply and as desired by way of operating the adjusting screw 62.

For example, if the leak pressure of the excessive pressure leak valve 57 is set to a high value, when the engine 1 is operated at a low rotation speed, the relatively low pressure in the crank chamber 2 pressurizes fuel as it is and the fuel pressure is set at a relatively low pressure. When the engine 1 is operated at a high rotation speed, the relatively high pressure in the crank chamber 2 pressurizes fuel as it is and the fuel pressure is set at a relatively high pressure. Therefore, in the case of short one cycle time namely high speed rotation of the engine 1, the fuel pressure is higher than that in low speed rotation, and the required quantity of fuel can be injected within a relatively shorter time. In other words, because the fuel pressure rises with increasing in rotation speed, the fuel injection quantity can be controlled by opening the injection orifice of the electronic controlled fuel injection system 30 for a required time period.

For example, if the leak pressure of the excessive pressure leak valve is set to a low value, the air pressure applied to fuel is maintained at a relatively low value regardless of the rotation speed of the engine 1.

In this embodiment, fuel is contained in the fuel tank 10 having the sealed structure, and pressurized in a predetermined pressure range by the fuel pressure control valve which utilizes the air pressure in the crank chamber 2, thereby, the electronic controlled fuel injection system which controls injection quantity by way of open-or-close time period of the fuel injection orifice can inject fuel stably. Further because the fuel pressure control valve 25 functions to release air in the crank chamber 2 to the outside, the resistance for reciprocation of the piston P is reduced and the engine efficiency is improved.

A radio control model plane on which an engine 1 for models having an electronic controlled fuel injection system 30 of the embodiment often performs acrobatic flying such as loop flying unlike an actual plane which performs seldom such acrobatic flying. Under such severe flying condition, the fuel injection system injects fuel often unstably. In detail, the fuel in a fuel tank 10 and the fuel in a fuel feeding pipe conduit which connects between a fuel tank 10 and the fuel injection system are affected adversely by gravity and centrifugal force due to exquisite operations of the model plane, and the magnitude and direction of the centrifugal force change rapidly time to time. The pressure applied to the fuel which has been supplied in the fuel injection system can not be maintained constant, and in the engine mounted on the model plane, fuel can be affected by the centrifugal force and gravity to result in unstable feeding of fuel.

However, in the engine for models of the embodiment, because fuel in the sealed fuel tank 10 is pressurized by means of the fuel pressure control valve 25 which utilizes pulsatory pressure in the crank chamber 2, the electronic controlled fuel injection system 30 can be used, low speed and high speed operation stability is improved, the engine responses quickly to the requirement for rapid acceleration and also deceleration, and the output of the engine is improved.

In the embodiment described hereinbefore, fuel which is substantially sealed in the fuel tank 10 is pressurized by means of the fuel pressure control valve, and supplied to the electronic controlled fuel injection system 30. However, in the case that the electronic controlled fuel injection system has a structure which substantially seals fuel in the internal, for example, in the case that the electronic controlled fuel injection system receives fuel through a fuel inverse flow preventing means, alternately the fuel supply system may have a structure in which the electronic controlled fuel injection system receives non-pressurized fuel, the air pressure intake port 51 of the fuel pressure control valve 25 of the embodiment is connected to the electronic controlled fuel injection system, and the air pressure supplied from the fuel pressure control valve 25 pressurizes directly fuel in the electronic controlled fuel injection system.

In the example described herein above, fuel pressurized by the fuel pressure control valve 25 is supplied into the internal of a cylinder by the electronic controlled fuel injection system 30. However, fuel pressurized by the fuel pressure control valve of the present invention may be supplied to a carburetor having a needle valve. In such case, fuel pressurized at a constant pressure is supplied to the needle valve, thereby, the air-fuel ratio is controlled, rotation speed is stabilized, and particularly influence of gravity and centrifugal force on fuel is eliminated to result in stable operation.

Figure 3:
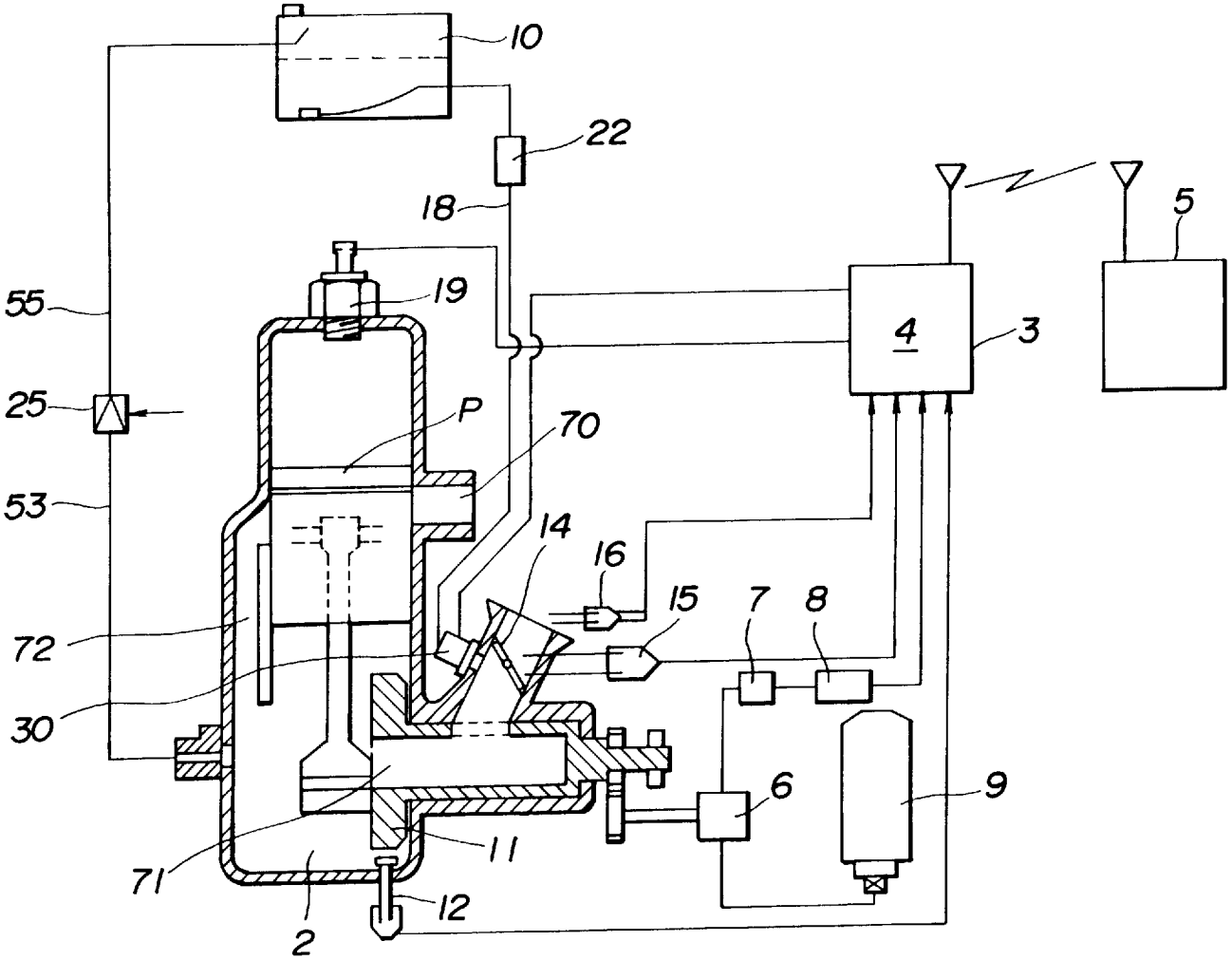
FIG. 3 is a schematic structural diagram of an engine of the second exemplary fuel pressure control valve in accordance with the embodiment of the present invention.
Figure 4:
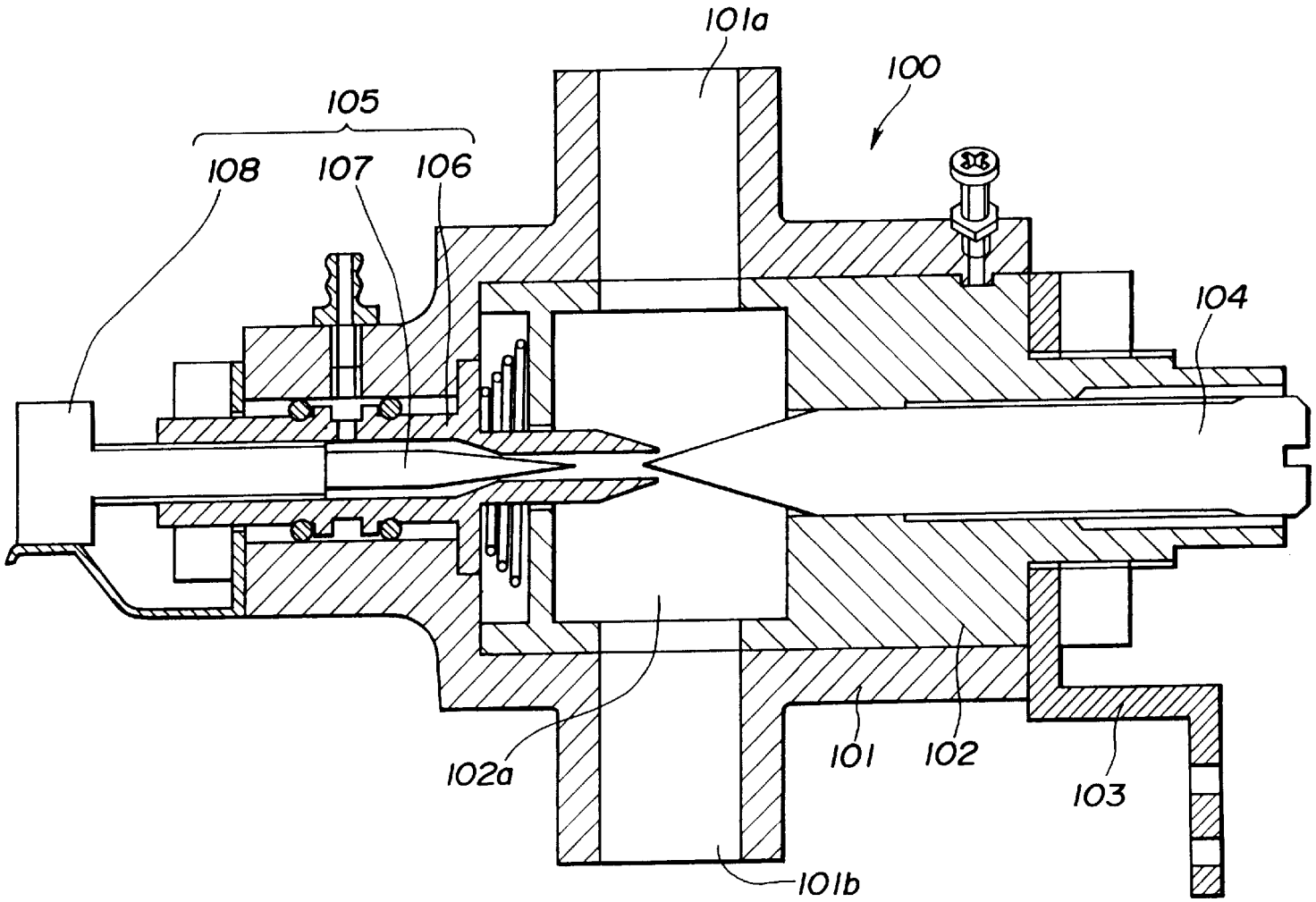
FIG. 4 a cross-sectional view of a conventional carburetor.

The second embodiment of the present invention is described with reference to FIG. 3. This embodiment involves a two-cycle engine for models provided with an electronic controlled fuel injection system. A two-cycle engine has neither intake valve 65 nor exhaust valve unlike a four-cycle engine, an exhaust vent 70, intake port 71, and scavenging port 72 are formed on a cylinder directly as shown in FIG. 3, and a piston P itself operates opening-closing of these ports. The same functional components in FIG. 3 as shown in FIG. 1 are given the same characters shown in FIG. 1, and detailed description is omitted. In this embodiment, the fuel pressure control valve 25 which is the same component as described in the first embodiment pressurizes fuel in the fuel tank 10 utilizing the air pressure generated in the crank chamber 2, and the pressurized fuel is supplied to the electronic controlled fuel injection system 30 provided to the carburetor side (throttle valve side).

The operation of this engine is described. When the piston P goes down with explosion of vent 70 is ops, the exhaust vent 70 is opened to start discharging of combustion gas, then the scavenging port 72 is opened. The pressure in the cylinder is lowered and the pressure in the crank chamber 2 is increased. The air in the crank chamber 2 flows into the cylinder from the opened scavenging port 72, and excludes combustion gas in the cylinder through the exhaust vent 70. When the piston P turns to go up, the pressure in the crank chamber 2 becomes negative, air begins to flow from the intake port 71 into the crank chamber 2.

The fuel pressure control valve 25 applies the predetermined air pressure to fuel in the fuel tank 10 which pressure is adjusted by operating the adjusting screw 62, the fuel with the predetermined pressure is supplied stably to the electronic controlled fuel injection system 30. The electronic controlled fuel injection system 30 begins to actuate at the end of a suction stroke, and injects atomized fuel into the crank chamber during a compression stroke. When the piston P goes up to the top dead center, the piston P closes the exhaust vent 70 and scavenging port 72 to make the internal of the cylinder air tight, and air-fuel mixture in the cylinder is compressed. When the piston P comes to the top dead point, the glow plug 19 ignites the air-fuel mixture to start combustion. The explosion force forces the piston P to turn to go down, and the engine enters to an exhaust stroke.

This embodiment also involves the substantially same advantage as described for the first embodiment, namely the stable injection by means of the electronic controlled fuel injection system 30.

In the description of the respective embodiments hereinbefore, the fuel pressure control valve is described which is to be mounted on radio controlled model planes, however, the model plane is not limited to radio controlled model planes for hobby but also includes various movable bodies used in industrial fields on which a relatively small engine is mounted, in detail, includes model automobiles and model boats.

In the case of a four-cycle engine, the absolute value of positive pressure and negative pressure generated in the crank chamber 2 is equal, but in the case of a two-cycle engine, the absolute value is different. In a two-cycle engine, air flows from the intake port 71 into the crank chamber 2 during a compression stroke, therefore the absolute value of negative pressure peak value generated in the crank chamber 2 during a compression stroke is lower than the absolute value of positive pressure peak value generated in the crank chamber 2 during an expansion stroke.

The fuel pressure control valve for engines of models of the present invention applies a predetermined pressure to fuel utilizing the air pressure in the crank chamber, therefore provides stable injection using the electronic controlled fuel injection system which controls injection quantity by varying open-close time period of the fuel injection orifice, operation stability of a model is improved in low speed and high speed operation, the engine responds quickly to the requirement of rapid acceleration and deceleration, and the output of the engine is improved.

In the case that fuel pressurized by the fuel pressure control valve for engines of models of the present invention is supplied to a carburetor having a needle valve, also the air-fuel ratio is controlled to result in stable rotation, and particularly adverse influence of gravity and centrifugal force on fuel is eliminated to result in stable operation.

What is claimed is:

1. A fuel pressure control valve of an engine for models provided to an engine for models for applying a predetermined pressure to fuel using the fluctuating air pressure generated in a crank chamber during operation, wherein said fuel pressure control valve is provided with;

an excessive pressure leak valve which is actuated when the air pressure supplied from said crank chamber exceeds a predetermined value to release partially said air pressure to the outside, and a check valve for preventing the air pressure applied to fuel from flowing inversely to the supply side.

2. The fuel pressure control valve of an engine for models as claimed in claim 1, wherein said fuel to which the air pressure is applied is contained in a sealed fuel tank.

3. The fuel pressure control valve of an engine for models as claimed in claim 1, wherein said fuel to which the air pressure is applied is supplied to an electronic controlled fuel injection system.

4. The fuel pressure control valve of an engine for models as claimed in claim 1, wherein said fuel pressure control valve has a pressure sensor for detecting the air pressure supplied from said crank chamber.

5. A fuel pressure control valve of an engine for models provided to an engine for models and for applying a predetermined pressure to fuel which is contained in a sealed space using the fluctuating air pressure generated in a crank chamber during operation, wherein said fuel pressure control valve is provided with;

an air pressure intake guide for guiding the air pressure from said crank chamber to said sealed space, an excessive pressure leak valve provided to said air pressure intake guide and for releasing partially said air pressure from said air pressure intake passage to the outside when the air pressure supplied from said crank chamber exceeds a predetermined value, a check valve for preventing the air pressure applied to said sealed space from flowing inversely to said air pressure intake guide, an outside air intake port for communicating from said air pressure intake guide to the outside air, an intake valve for preventing air from releasing from said outside air intake port to the outside when the air pressure generated in said crank chamber becomes positive, and for allowing air to flow from said outside air intake port to said crank chamber when the air pressure generated in the said crank chamber becomes negative which intake valve is provided to said outside air intake port.

* * * * *